US005390828A

United States Patent [19]

Gross

[11] Patent Number: 5,390,828

[45] Date of Patent: Feb. 21, 1995

[54] CLOSURE WITH TWO-PART SLIDABLE DISPENSING CAP

[75] Inventor: Richard A. Gross, Oconomowoc, Wis.

[73] Assignee: Aptargroup, Inc., Crystal Lake, Ill.

[21] Appl. No.: 65,553

[22] Filed: May 20, 1993

[51] Int. Cl.[6] ..... B65D 37/00

[52] U.S. Cl. ..... 222/211; 222/212; 222/481.5; 222/531; 222/561

[58] Field of Search ..... 222/211, 212, 48.15, 222/482, 531, 532, 537, 561

[56] References Cited

U.S. PATENT DOCUMENTS

| | | | |
|---|---|---|---|
| 2,823,836 | 2/1958 | Bach | 222/521 |
| 2,917,210 | 12/1959 | Libit | 222/512 |
| 2,918,200 | 12/1959 | Libit | 222/512 |
| 2,969,167 | 1/1961 | Libit | 222/512 |
| 2,971,680 | 2/1961 | Wilson et al. | 222/512 |
| 3,155,292 | 11/1964 | Webster | 222/397 |
| 3,622,032 | 11/1971 | Tilche | 220/20.5 |
| 4,522,317 | 6/1985 | Goncalves | 222/391 |
| 4,658,979 | 4/1987 | Mietz et al. | 220/209 |
| 4,921,071 | 5/1990 | Lonnborg et al. | 220/203 X |
| 4,969,581 | 11/1990 | Seifert et al. | 222/212 |
| 4,982,882 | 1/1991 | Gueret | 22/531 |
| 5,005,737 | 4/1991 | Rohr | 222/212 |
| 5,054,634 | 10/1991 | Margotteau | 215/322 |
| 5,115,949 | 5/1992 | Rosenthal | 222/211 |
| 5,165,581 | 11/1992 | Uhl | 222/481.5 X |
| 5,169,035 | 12/1992 | Imbery, Jr. | 222/212 |

FOREIGN PATENT DOCUMENTS

| | | | |
|---|---|---|---|
| 2233248 | 1/1975 | France . | |
| 2027670 | 12/1971 | Germany | 222/532 |
| 1462508 | 1/1977 | United Kingdom . | |
| 2112761 | 7/1983 | United Kingdom | 222/561 |

*Primary Examiner*—Andres Kashinikow
*Assistant Examiner*—Joseph A. Kaufman
*Attorney, Agent, or Firm*—Dressler, Goldsmith, Shore & Milnamow, Ltd.

[57] ABSTRACT

A dispensing closure is provided for a squeezable container. The closure has a body with a top wall and an upwardly projecting discharge tube defining a discharge passage in communication with said container opening. A cap defines a dispensing conduit extending between an inlet aperture and a dispensing aperture, and the cap is slidable on the body top wall between open and closed positions. A hollow fitment has a first portion slidably disposed on the discharge tube and has a second portion that projects into the cap inlet aperture and that is disposed in the cap dispensing conduit to accommodate sliding movement of the cap relative to the fitment. The fitment defines an intermediate passage for communicating between the body discharge tube discharge passage and the cap dispensing conduit. The fitment is movable on the discharge tube between (1) an elevated dispensing position accommodating fluid flow out of the cap dispensing aperture and (2) a closed position wherein fluid is prevented from flowing out of the cap dispensing aperture.

20 Claims, 4 Drawing Sheets

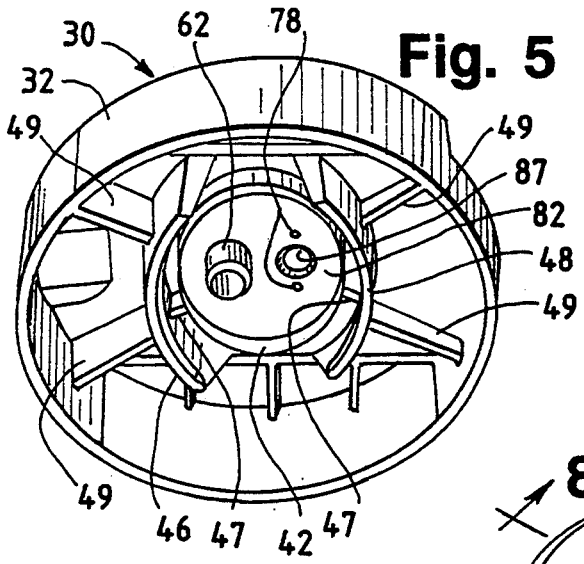
Fig. 5
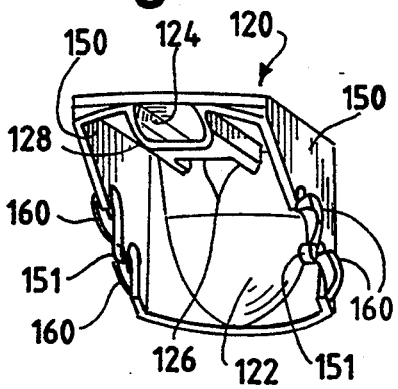
Fig. 6
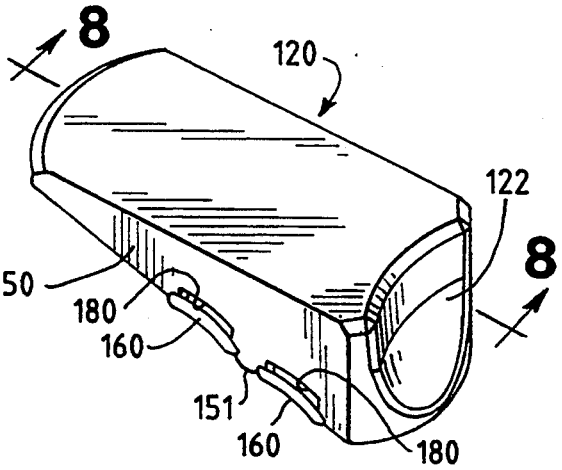
Fig. 7
Fig. 8
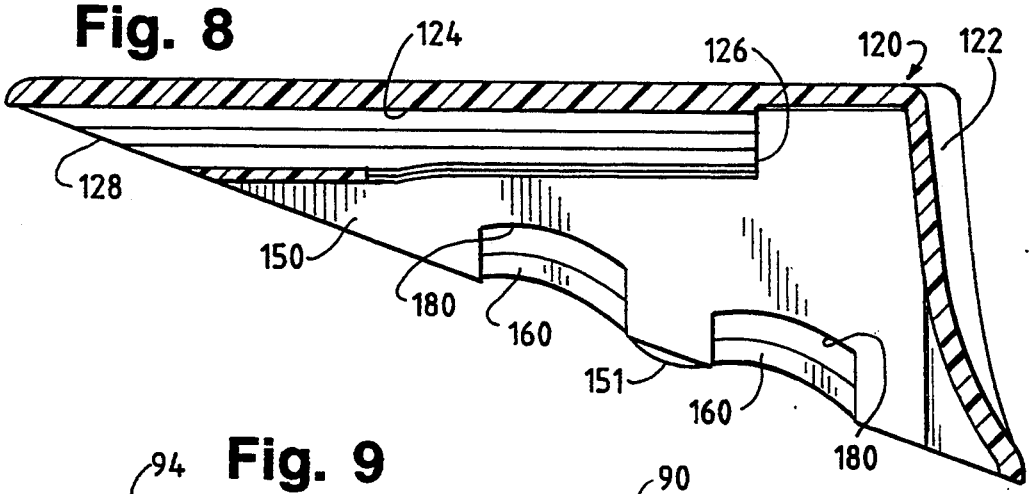
Fig. 9
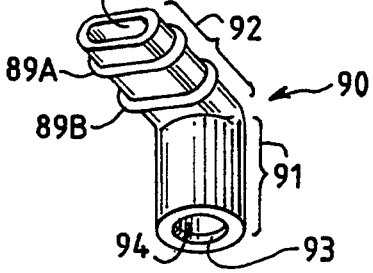
Fig. 10
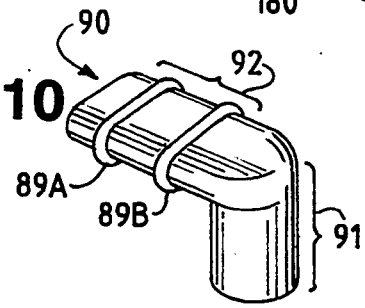

CLOSURE WITH TWO-PART SLIDABLE DISPENSING CAP

TECHNICAL FIELD

This invention relates to container closures, and more particularly to squeezable bottle dispensing closures of the type which have a dispensing member which can be moved from a closed position to an open position to permit dispensing of a fluid product from the bottle when the bottle is squeezed.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluids.

A popular package design is the squeezable bottle or flexible container which is intended to be squeezed by the user to dispense the product. Such a container typically includes a closure through which the product is dispensed when the closure is manipulated to an open position. See, for example, U.S. Pat. Nos. 5,115,949 and 5,054,634 and United Kingdom Patent Specification No. 1,462,508.

In some designs, the closure incorporates a moveable member, such as a lid, which can be positioned to open or close a dispensing orifice. In addition, some of the designs incorporate a system for venting of air into the container to equalize the internal and external pressures when the squeezing forces are removed from the container.

While the above-discussed types of closures may function generally satisfactorily for the purposes for which they were designed, it would be desirable to provide an improved dispensing closure with structural and operational advantages. In particular, it would be advantageous to provide a dispensing system which could be incorporated in a "high-style" design exhibiting a compact, stream-lined profile having an aesthetically pleasing exterior configuration substantially free of functional details and outwardly projecting features.

Additionally, such an improved dispensing closure should effectively occlude the dispensing passage to provide tight shut off when the closure is closed. The closure should also incorporate a sealing system that is effective to prevent or minimize unwanted leakage onto and around the closure parts when the closure is in the open or closed positions, as well as when the closure is manipulated or moved between the open and closed positions.

It would also be desirable to provide an improved dispensing closure with means for efficiently venting air into the container, as well as a closure which can function to effectively dispense product from the container even when the container is nearly empty.

Further, it would be beneficial to provide an improved design in which the closure can be operated on the container while the container is in a substantially vertical position and can also provide a dispensing spout for discharging the product downwardly from the closure into the hand of a user.

Finally, such an improved closure should incorporate effective structural stop mechanisms for facilitating actuation of the closure between the open and closed positions.

The present invention provides an improved dispensing closure which can accommodate designs having the above-discussed benefits and features.

SUMMARY OF THE INVENTION

The present invention provides a novel, dispensing closure for a squeezable container. The closure includes a body which has a top wall defining a discharge passage in communication with an opening in the container.

The closure includes a cap that is movable on the body top wall and that defines a dispensing conduit extending between an inlet aperture and a dispensing aperture.

A hollow fitment is operatively associated with the cap. The hollow fitment has a first portion slidably disposed along the closure body discharge passage and has a second portion that projects into the cap inlet aperture and that is disposed in the cap dispensing conduit to accommodate sliding movement of the cap relative to the fitment. The fitment defines an intermediate passage for communicating between the body discharge passage and the cap dispensing conduit. The fitment is movable along the discharge passage between (1) an elevated dispensing position accommodating fluid flow out of the cap dispensing aperture and (2) a lowered closed position wherein the fluid is prevented from flowing out of the cap dispensing aperture.

According to a further aspect of a preferred form of the invention, the body top wall defines an exterior surface on which the cap is disposed. The exterior surface defines front and rear indentations spaced-apart in a linear array. The bottom edge of the cap defines a protuberance shaped to be selectively received in either of the indentations corresponding to the dispensing and closed positions.

According to a preferred form of the invention, the body top wall has an interior surface in communication with the container opening. The top wall defines a vent passage extending from the interior surface to the exterior of the top wall. The body includes a resilient sealing means mounted to the top wall adjacent the top wall interior surface for sealingly engaging the interior surface around the vent passage in a normally closed position and for being shifted out of sealing engagement with the interior surface when the ambient atmospheric pressure exceeds the pressure within the container to permit equalization of the container pressure with the ambient atmospheric pressure.

All of the above-described features are employed in the preferred embodiment. The closure can thus be easily moved between releasably engaged dispensing and closed positions. In the closed position, the closure is effectively sealed and prevents unwanted leakage.

Further, the vent system permitting equalization of the container pressure is effective in facilitating return of the container to the undeformed condition.

Preferably, the body also has a hollow dip tube extending from the discharge passage into the container. The use of a dip tube in the closure of the preferred embodiment permits the product to be dispensed quickly, even when the container is substantially empty, without requiring inversion of the container.

Finally, a preferred embodiment of the invention accommodates a design in which the dispensing aperture can project outwardly from the container when the closure is in the open position and can discharge the container contents downwardly in a convenient manner onto an article or onto a hand of the user.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 is a bottom, perspective view of the closure body with the vent valve and dip tube removed;

FIG. 6 is a front, perspective view of the closure cap removed from the closure body;

FIG. 7 is a perspective view of the cap shown in FIG. 6 as viewed from an upper rear corner;

FIG. 8 is a greatly enlarged, cross-sectional view taken generally along the plane 8—8 in FIG. 7;

FIG. 9 is a perspective view of the fitment which is adapted to be operably disposed on the closure body for engaging the cap;

FIG. 10 is a perspective view of the fitment shown in FIG. 9 as viewed from the upper rear;

DESCRIPTION OF THE PREFERRED EMBODIMENT

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in a normal (upright) operating position, and terms such as upper, lower, horizontal, etc., are used with reference to this position. It will be understood, however, that the closure of this invention may be manufactured, stored, transported, and sold in an orientation other than the position described.

Further, although the invention has been described or depicted as a separate, removable closure, the closure may be formed as an integral or unitary part of the top, or other portion, of a container.

Figure 1:
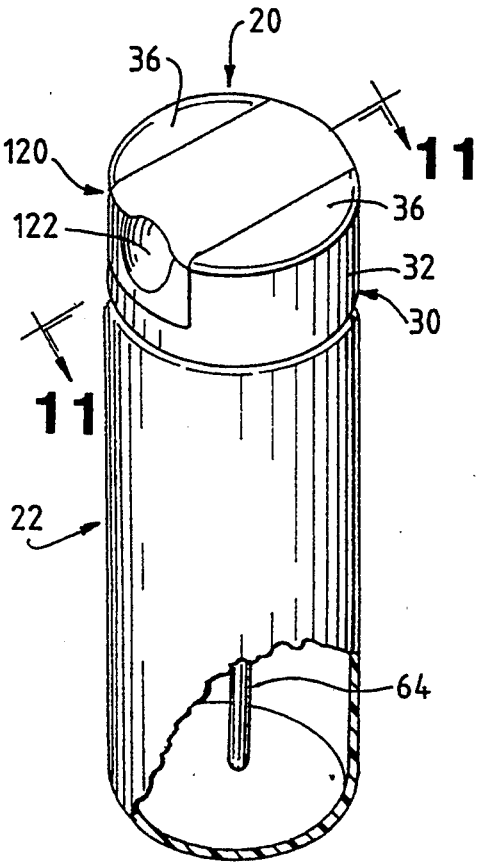
FIG. 1 is a perspective view of the closure of the present invention shown mounted in a closed position on a container with a portion of the container wall cutaway to illustrate interior detail.
Figure 2:
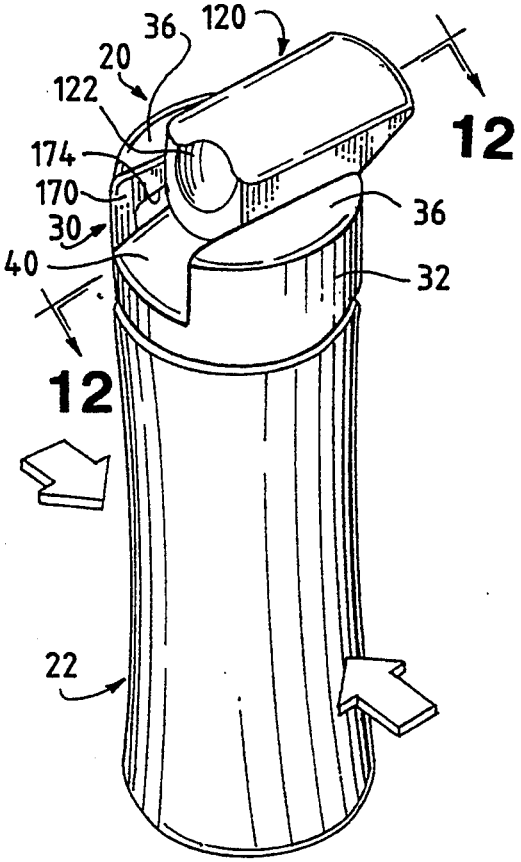
FIG. 2 is a view similar to FIG. 1 but showing the closure in an open, dispensing position.
Figure 11:
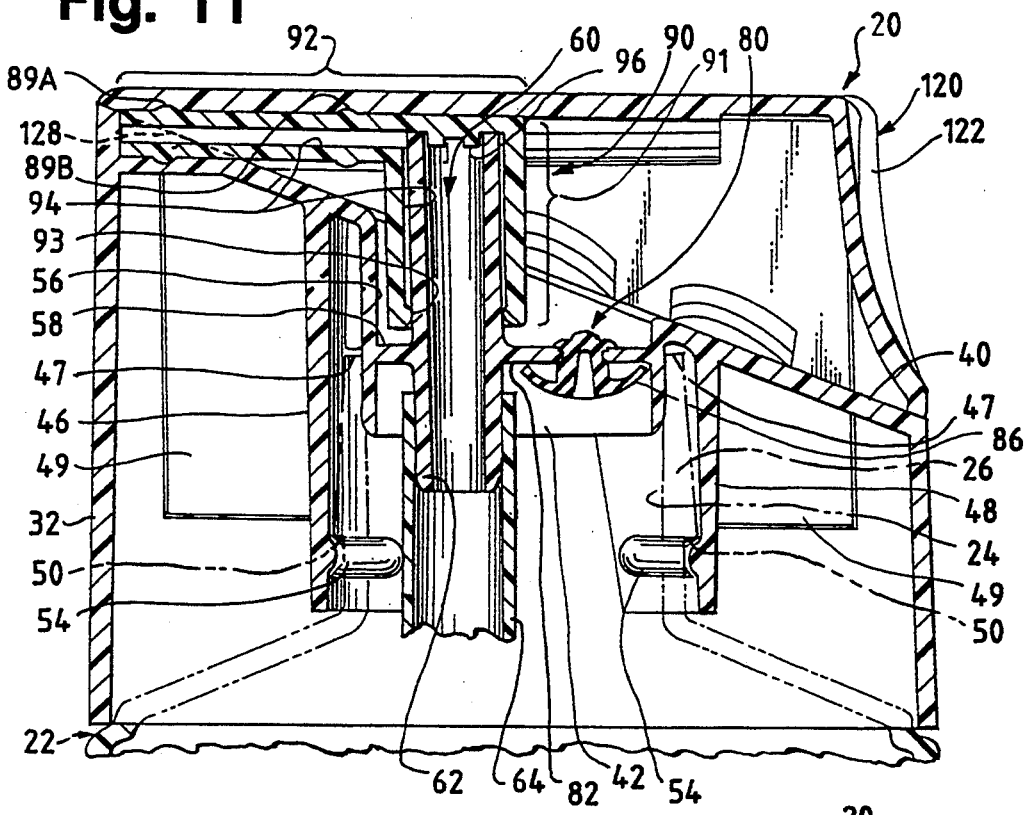
FIG. 11 is a greatly enlarged, fragmentary, cross-sectional view taken generally along the plane 11—11 in FIG. 1.
Figure 12:
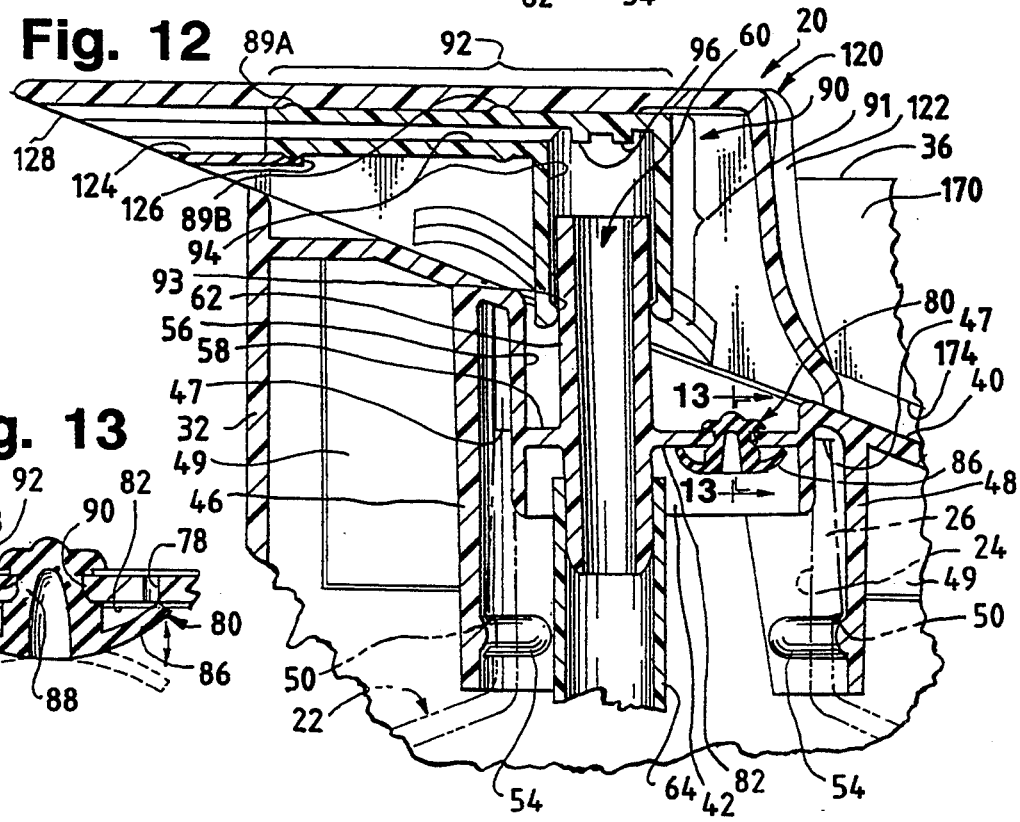
FIG. 12 is a greatly enlarged, fragmentary, cross-sectional view taken generally along the plane 12—12 in FIG. 2.

With reference now to FIGS. 1 and 2, a first embodiment of the closure of the present invention is represented generally by the reference numeral 20. The closure 20 is adapted to be disposed on a container 22. As illustrated in FIGS. 11 and 12, the container 22 has a conventional mouth or opening 24 defined by a neck 26 or other suitable structure. The container 22 is preferably fabricated from thermoplastic material, or other materials, compatible with the container contents and which accommodate squeezing of the container.

The container 22 may have a variety of different shapes, sizes, and constructions. In the embodiment illustrated in FIGS. 1 and 2, the container 22 has a generally cylindrical configuration projecting below the closure 20.

Typically, the container 22 is filled with a fluid consumer product, such as a skin lotion, a hair care product, or the like. Such containers may also hold fluid food items, household cleaners, and other types of consumer products, as well as commercial, industrial, and institutional products.

The container 22 would typically be shaped, sized, and constructed so as to facilitate the containment and dispensing of the particular product in the particular application for which the product is sold. Typically, the container 22 is molded from a suitable thermoplastic material to form a unitary structure. The side wall is preferably elastically deformable or flexible to accommodate manually applied pressure for squeezing the container. When the container closure 20 is in the open, dispensing position while the container 22 is squeezed, the fluid material within the container is forced out of the container through the open, dispensing closure in a manner that is described in detail hereinafter. The wall of the container is sufficiently resilient to return to the unstressed, unformed configuration when the squeezing pressure is released.

The closure 20 includes a base or body 30 for securement to the container 22. The body 30 includes a generally cylindrical, peripheral wall 32 and a top structure including a pair of spaced-apart, sector-shaped top walls 36 and a slanted, central top wall 40. The top wall 40 slants downwardly from front to rear as best illustrated in FIGS. 2, 3, 11 and 12.

As illustrated in FIGS. 5, 11, and 12, a cylindrical collar 42 projects downwardly from the underside of the central top wall 40. As illustrated in FIGS. 11 and 12, the collar 42 is adapted to be inserted into the container neck opening 24 in a frictional engagement with the container neck 26.

Front and rear retainer members 46 and 48, respectively, project downwardly from the underside of the closure body central top wall 40 as illustrated in FIGS. 4, 5, 11, and 12. As can be seen in FIG. 5, each retainer member 46 and 48 has a partially cylindrical configuration. A plurality of radially oriented, rigidifying ribs 47 (FIGS. 4 and 5) are provided between the exterior circumference of the collar 42 and the front and rear retainer members 46 and 48, respectively. As illustrated in FIGS. 11 and 12, the cylindrical members 46 and 48 are adapted to be received on the exterior of the container neck 26. The closure body 30 also has additional reinforcing ribs 49 extending between the peripheral wall 32 and the retainer members 46 and 48.

Typically, the container neck 26 includes an outwardly protruding bead 50 (FIGS. 11 and 12), and each retainer member 46 and 48 is provided with an inwardly projecting bead 54 for engaging the bottom of the container neck bead 50. Each retainer member 46 and 48 is somewhat resilient so as to accommodate the mounting of the closure 20 on the container neck 26. In particular, as the closure 20 is pushed downwardly onto the container neck, the retainer members 46 and 48 spread apart slightly as the retainer member beads 54 are cammed outwardly until they move past the container neck bead 50, and the retainer members 46 and 48 then spring inwardly to the normal, undeflected configuration so as to hold the closure 20 on the container 22.

Figure 3:
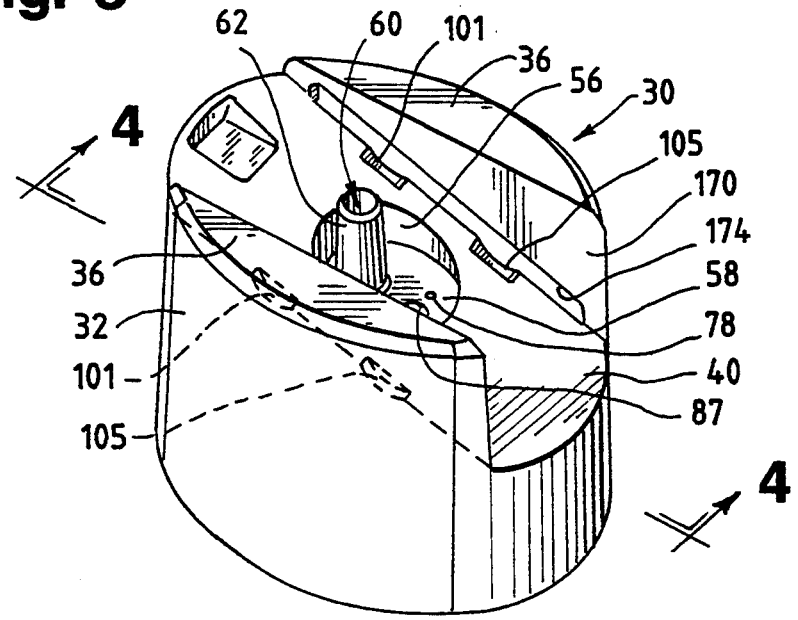
FIG. 3 is a top, perspective view of the closure body with the cap removed.
Figure 4:
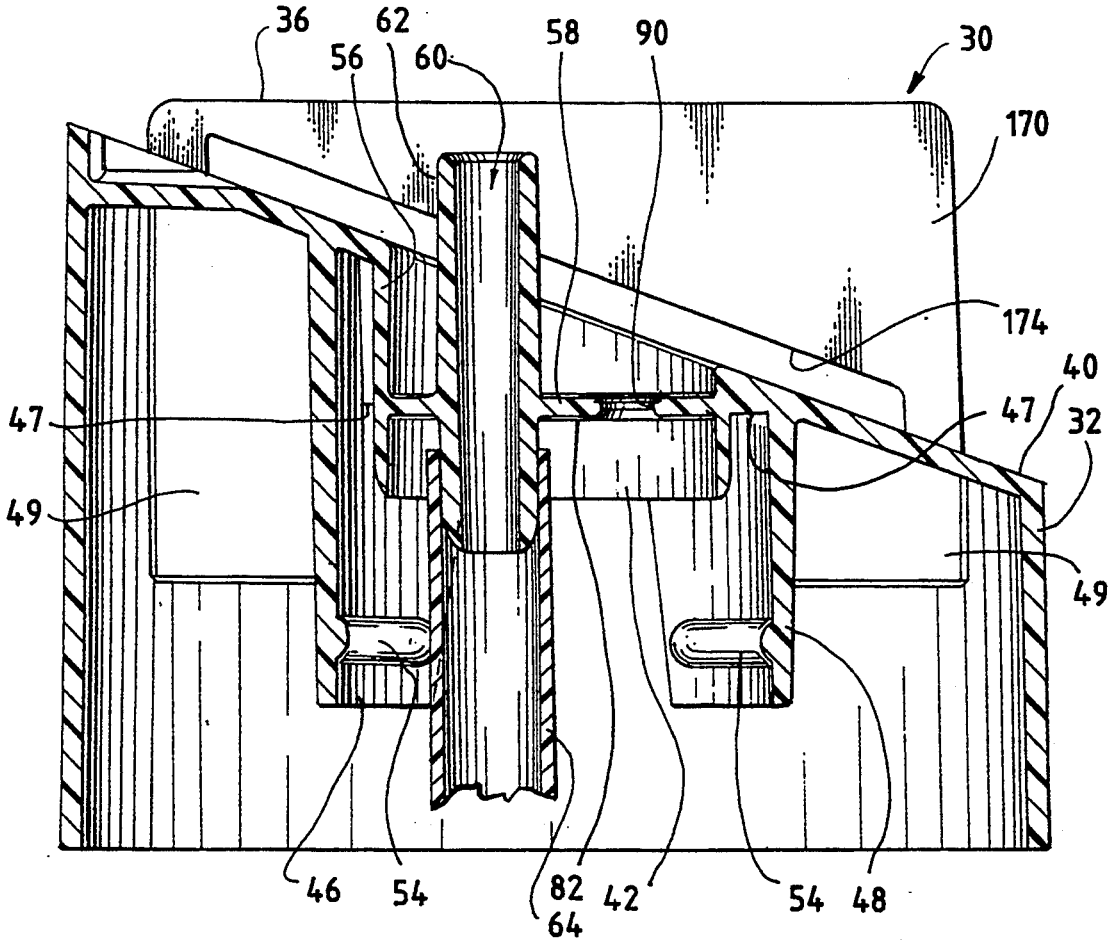
FIG. 4 is a greatly enlarged, fragmentary, cross-sectional view taken generally along the plane 4—4 in FIG. 3 and with the vent valve omitted.

As illustrated in FIGS. 3 and 4, the body top wall 40 has a well defined by a circular wall 56 and sunken deck 58. The body top wall sunken deck 58 defines a discharge passage 60 which is in communication with the container opening when the closure body 30 is assembled on the container 22. In the preferred embodiment, the discharge passage 60 is defined by a cylindrical conduit 62 extending downwardly from the body top wall sunken deck 58.

In the preferred embodiment, a dip tube 64 is connected to the lower end of the conduit 62 as illustrated in FIGS. 4, 11, and 12. The dip tube 64 may be fabricated from a suitable, conventional, thermoplastic material and may be somewhat flexible. The dip tube 64 may be secured to the conduit 62 by means of a friction fit or by other specific attaching means, such as with an adhesive, annular bead and groove interlock, etc. As illustrated in FIG. 1, the length of the dip tube 64 is sufficient to locate the bottom end of the dip tube near the bottom of the container 22.

Figure 13:
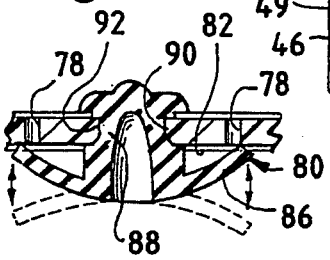
FIG. 13 is a greatly enlarged, fragmentary, cross-sectional view taken generally along the plane 13—13 in FIG. 12.

The closure body top wall deck 58 defines a pair of spaced-apart vent apertures 78 (FIGS. 3, 5, and 13). A vent valve 80 (FIGS. 3 and 13) is mounted to the closure body top wall deck 58 so as to normally occlude the vent apertures 78. In particular, as can be seen in FIGS. 11–13, the closure body top wall sunken deck 58 defines an interior surface 82 around the vent apertures 78. The interior surface 82 is in communication with the container opening. The vent apertures 78 extend from the interior surface 82 to the exterior of the top wall sunken deck 58.

Preferably, the vent valve 80 is molded from a suitable resilient material, such as a thermoplastic polymer rubber. As shown in FIG. 13, the vent valve 80 includes a generally annular, "umbrella"-shaped, resilient sealing means 86 extending radially from a central mounting post 88. The central mounting post 88 projects into a mounting hole 87 (FIGS. 3, 4 and 5) in the closure body top wall 40. The mounting stem 88 defines an annular groove 92 for engaging the reduced diameter, circular edge portion of the mounting hole 87.

Normally, the resilient sealing member 86 of the valve 80 is sealingly engaged with the closure body end wall interior surface 82 (FIGS. 11 and 12). This is the "closed" position for the vent valve 80 which prevents the container contents from being forced out of the vent apertures 78. When the container 22 is squeezed, the increased internal pressure causes the valve 80 to seal even more tightly. On the other hand, when the ambient atmospheric pressure exceeds the pressure within the container 22, the vent valve 80 is shifted out of sealing engagement (as illustrated in dashed lines in FIG. 13) to permit equalization of the container pressure with the ambient atmospheric pressure.

A hollow fitment 90 (FIGS. 9–12) is disposed on the conduit 62. The fitment 90 has a first portion 91 slidably disposed along the discharge passage 60 on the discharge tube 62. The fitment 90 also includes a second portion 92. On the exterior surface of the fitment second portion 92 there are two, spaced-apart, outwardly extending beads 89A and 89B which provide special functions as described hereinafter.

The fitment 90 defines a passage 94 that extends through the fitment from the bottom of the first portion 91 to the distal end of the second portion 92. The inside surface of the passage 94 defines an inwardly extending, annular seal bead 93 for sealing against the exterior surface of the discharge tube 62.

Within the fitment 90, there is a downwardly projecting, annular seal ring 96 which is adapted to be received within, and seal against, the inner periphery of the upper end of the conduit 62 as illustrated in FIG. 11. The fitment 90 is movable along the discharge passage 60 on the conduit 62 between (1) an elevated, dispensing position for accommodating the discharge of fluid flow as illustrated in FIG. 12 and (2) a lowered, closed position wherein fluid is prevented from flowing out of the fitment as illustrated in FIG. 11.

The closure body top wall 40 also defines a pair of front recesses or indentations 101 (FIG. 3) and a pair of rear indentations 105 (FIG. 3). The indentations are oriented in two sets of spaced-apart, linear arrays along the lateral margins of the central top wall 40. The indentations 101 and 103 each have a generally smooth, but arcuate, surface which merges with the exterior surface of the top wall 40. In the preferred embodiment, the indentations 101 and 105 are identically shaped.

A cap 120 (FIGS. 6 and 7) is slidably disposed on the closure body top wall 40 as illustrated in FIGS. 1, 2, 11, and 12. The cap 120 includes a rear, finger push-wall 122 (FIGS. 1, 2, 6, 7, 8, 11, and 12).

The cap 120 has an internal structure defining a dispensing conduit 124 (FIGS. 6, 8, 11, and 12) which extends between an inlet aperture 126 (FIG. 8) and an outlet or dispensing aperture 128 (FIG. 8). The fitment 90 is disposed so that the second portion 92 projects into the cap inlet aperture 126. Thus the fitment second portion 92 is received in the cap dispensing conduit 124 to accommodate sliding movement of the cap 120 relative to the fitment 90. The fitment passage 94 thus communicates between the body discharge passage 60 defined by the tube 62 and the cap dispensing conduit 124. The fitment second portion 92 is sealed within the cap dispensing conduit by the bead 89A. The bead 89B bears against the surface of the cap dispensing conduit 124 to act as a stabilizer for preventing binding of the fitment 90 within the conduit 124 as the cap 120 slides relative to the fitment 90.

As best illustrated in FIG. 6, the cap 120 has a pair of spaced-apart side walls 150. Each side wall 150 includes a downwardly projecting protuberance 151. Each protuberance 151 is shaped to be selectively received in either of the recesses 101 and 105.

As illustrated in FIGS. 6, 7, and 8, each protuberance 151 has a generally arcuate shape. In the preferred form illustrated, each protuberance 151 has a shape which conforms substantially to the shape of the closure body top wall recesses or indentations 101 and 105. Preferably, the projection of each protuberance 151 is about equal to, or less than, the depth of the recesses 101 and 105.

Each side wall 150 includes a pair of tabs 160 projecting laterally on either end of one of the protuberances 151 as illustrated in FIGS. 6–8. Each tab 160 is arcuate as viewed in side elevation (FIGS. 7 and 8). Further, immediately above each tab 160, the side wall 150 is cut out to define an aperture 180 (FIGS. 7 and 8). Because each tab 160 spans the aperture 180, each tab 160 is somewhat resilient and can be deflected downwardly when sufficient force is applied. This accommodates movement of the cap 120 between the closed position (FIG. 11) and the open dispensing position (FIG. 12) as explained in detail hereinafter.

The tabs 160 are adapted to function, in conjunction with structures on the closure body, as retainer means for retaining the cap 120 on the body top wall 40. Specifically, as can be seen in FIGS. 3 and 4, at each lateral margin of the closure body top wall 40 there is a side wall 170 which extends upwardly to one of the sector-shaped top walls 36. As illustrated in FIGS. 2, 3 and 4, each upwardly extending side wall 170 defines a slot 174. The slots 174 are adapted to each receive a pair of cap tabs 160. On each side of the cap 120, the side wall 170 along the top of the slot 174 bears against the upwardly facing surfaces of the pair of tabs 160. This forces the cap 120 against the body top wall 40 and maintains the engagement of the protuberances 151 in a selected one of the closure body top wall indentations 101 and 105.

When the cap 120 is in the closed position as illustrated in FIG. 11, the cap protuberances 151 are matingly received in the closure body top wall indentations 105. In this closed position, the discharge conduit 62 is closed at the top by the downwardly projecting annular seal ring 96, and the conduit 62 therefore does not communicate with the cap dispensing conduit 124. Further, the dispensing aperture 128 at the front of the cap 120 is occluded by the fitment second portion 92 which is received within the closure body peripheral wall 32. Thus, the contents of the container 22 cannot be dispensed when the container 22 is squeezed.

When the cap 120 is moved forwardly from the closed position (FIG. 11) to the dispensing position (FIG. 12) (as by pushing on the push surface 122), the protuberances 151 tend to slide forwardly out of the mating indentations 105. In order for the forward movement to occur, the cap 120 must necessarily be elevated somewhat relative to the top, exterior surface of the closure body top wall 40. This elevation is accommodated by the resilient nature of each tab 160 which undergoes a slight downward deflection caused by engagement with the top of the side wall slot 174. This allows the cap 120 to be cammed upwardly as the protuberances 151 slide up and out of the recesses 105.

As the cap 120 is slid forwardly (toward the open position illustrated in FIG. 12), the protuberances 151 engage the upwardly facing, flat, exterior surface of the closure body top wall 40 until the open position is reached. In the open position (FIG. 14), the cap 120 is biased downwardly by the tabs 160 (which push upwardly against the top of the side wall slot 174) so that the protuberances 151 are received in the closure body top wall indentations 101.

In the open position, the cap dispensing conduit 124 is properly positioned to accommodate dispensing of a container contents over the side of the closure when the container 22 is squeezed. In particular, the fitment seal 96 is now spaced away from the closure body discharge passage 60, and the cap dispensing aperture 128 projects beyond the closure body 30. In this position, the cap 120 functions as a small spout and permits the user to place a hand under the spout for receiving the dispensed product. Further, because the dip tube 64 extends to near the bottom of the container 22, squeezing of the container 22 forces the product up the dip tube 64 even when the container is nearly empty. The user does not have to invert the container and wait for the contents to drain out.

When the squeezing pressure is released, the greater ambient atmospheric pressure forces air through the vent apertures 78 and opens the vent valve 80 so that the internal container pressure is equalized with the external ambient atmospheric pressure.

The open cap 120 can be readily moved back to the closed position by pushing the cap 120 rearwardly. This is accomplished by pushing the cap rearwardly with sufficient force to cause the cap tabs 160 to be deflected downwardly somewhat by the closure body side walls 170 defining the tops of the slots 174. The user can tell when the cap 120 has been returned to the fully closed position (FIG. 11) because the biasing engagement between the cap tabs 160 and the tops of the side wall slots 174 will urge the protuberances 151 into the mating indentations 105.

The present invention also contemplates a modification of the above-described embodiment which simplifies the structure. Specifically, the simplified structure eliminates the dip tube 64 and/or vent system (vent apertures 78 and vent valve 80). Such a design can be employed in lower cost and less critical applications where the loss of the operational benefits of a dip tube and/or vent system can be tolerated.

The novel dispensing closure of the present invention can be easily manipulated with one hand from the closed configuration to the dispensing configuration. In the preferred arrangement, the various contacting surfaces of the closure structure components are in sealing engagement when located at, and between, the closed and open positions, and this prevents flow other than through the open discharge passages and out of the outlet (dispensing) aperture 128.

In the preferred form, the invention accommodates a design in which the dispensing aperture projects outwardly from the container when the closure is in the open position so that the container contents can be discharged downwardly in a convenient manner onto an article or onto a hand of the user.

Further, in the preferred embodiment of the closure, the unique vent systems permits equalization of the container pressure for facilitating return of the container to the undeformed condition. Also, the dip tube permits the product to be dispensed quickly, even when the container is substantially empty, without requiring inversion of the container.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall laterally across said top wall and defining a dispensing conduit extending between an inlet aperture and a dispensing aperture; and a hollow fitment separate from, but engaged with, said cap, said fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture.

2. The closure in accordance with claim 1 in which said fitment second portion has a distal end defining a discharge opening communicating with said intermediate passage; and said body includes a sealing wall for occluding said fitment discharge opening when said fitment is in said closed position.

3. The closure in accordance with claim 1 in which said discharge passage is defined by generally cylindrical tube that projects upwardly from said top wall and that has an annular distal end; and said body top wall defines a planar slide surface on which said cap is slidably mounted, said planar slide surface being oriented at an oblique angle relative to the longitudinal axis of said cylindrical discharge tube.

4. The closure in accordance with claim 1 in which said body top wall has an interior surface in communication with said container opening, said top wall defining a vent passage extending from said interior surface to the exterior of said top wall, and said body includes a resilient sealing means mounted to said top wall adjacent said top wall interior surface for sealingly engaging said interior surface around said vent passage in a normally closed position and for being shifted out of sealing engagement with said interior surface when the ambient atmospheric pressure exceeds the pressure within the container to permit equalization of the container pressure with the ambient atmospheric pressure.

5. The closure in accordance with claim 1 in which said closure body discharge passage is defined in part by a tube that extends downwardly through said top wall to define part of said discharge passage below said top wall; and said body includes a hollow dip tube having (1) an upper end mounted to the end of said downwardly extending tube and (2) a lower end extending into said container.

6. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall laterally across said top wall and defining a dispensing conduit extending between an inlet aperture and a dispensing aperture; and a hollow fitment separate from, but engaged with, said cap, said fitment having a first portion slidably disposed on said discharge tube and having a second portion that projects into said cap inlet aperture and that is disposed in said cap dispensing conduit to accommodate sliding movement of said cap on said slide surface relative to said fitment, said fitment defining an intermediate passage for communicating between said body discharge tube discharge passage and said cap dispensing conduit, said fitment being movable on said discharge tube between (1) an elevated dispensing position accommodating fluid flow out of said cap dispensing aperture and (2) a lowered closed position wherein fluid is prevented from flowing out of said cap dispensing aperture.

7. The closure in accordance with claim 6 in which said fitment second portion has a distal end defining a discharge opening communicating with said intermediate passage; and said body includes a sealing wall for occluding said fitment discharge opening when said fitment is in said closed position.

8. The closure in accordance with claim 6 in which said discharge tube is generally cylindrical and has an annular distal end; and said body has a top wall defining said planar slide surface on which said cap is slidably mounted.

9. The closure in accordance with claim 6 in which said body has an interior surface in communication with said container opening, said body defining a vent passage extending from said interior surface to the exterior of said body, and said body includes a resilient sealing means mounted adjacent said top wall interior surface for sealingly engaging said interior surface around said vent passage in a normally closed position and for being shifted out of sealing engagement with said interior surface when the ambient atmospheric pressure exceeds the pressure within the container to permit equalization of the container pressure with the ambient atmospheric pressure.

10. The closure in accordance with claim 6 in which said closure body discharge tube extends downwardly through said closure body planar slide surface to define part of said discharge passage below said slide surface; and said body includes a hollow dip tube having (1) an upper end mounted to the end of said downwardly extending tube and (2) a lower end extending into said container.

11. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall and defining a dispensing conduit extending between an inlet aperture and a dispensing aperture; and a hollow fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture;

said discharge passage being defined by generally cylindrical tube that projects upwardly from said top wall and that has an annular distal end;

said body top wall defining a planar slide surface on which said cap is slidably mounted, said planar slide surface being oriented at an oblique angle relative to the longitudinal axis of said cylindrical discharge tube;

said fitment including (a) a seal surface inside said first portion at one end of said first portion for engaging said annular distal end of said discharge tube to seal closed said discharge passage when said fitment is in said closed position, (b) a pair of spaced-apart, outwardly directed beads around said second portion, and (c) an inwardly directed bead at one end of said first portion at one end of said intermediate passage.

12. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall and defining a dispensing conduit extending between an inlet aperture and a dispensing aperture; and a hollow fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture;

said closure further including retainer means for retaining said cap on said top wall to accommodate sliding movement of said cap between (1) an extended, dispensing position in which said cap dispensing aperture projects laterally beyond said closure and (2) a closed position in which said cap dispensing aperture is disposed within the periphery of said body.

13. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall and defining a dispensing conduit extending between an inlet aperture and a dispensing aperture; and a hollow fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture;

said closure body top wall being generally planar;

said closure body including a pair of spaced-apart side walls each defining a guide slot parallel to, and extending along an edge of, said closure body top wall;

each said side wall having a guide surface oriented parallel to said top wall and defining the top of said guide slot; and said cap having at least one pair of oppositely extending tabs each received in one of said side wall slots, each said tab having a resilient, arcuate configuration with an upper surface engaging the guide surface of the side wall slot in which it is received whereby said side walls and said tabs function as said retainer means.

14. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall and defining a dispensing conduit extending between an inlet aperture and a dispensing aperture; and a hollow fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture;

said body top wall defining an exterior surface on which said cap is disposed;

said exterior surface defining front and rear indentations spaced-apart in a linear array; and said cap defining a protuberance shaped to be selectively received in either of said indentations corresponding to said dispensing and closed positions.

15. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which has a top wall and which can be mounted to said container with said top wall disposed over said container opening, said body having a discharge passage through said top wall in communication with said container opening;

a cap movable on said top wall and defining a dispensing conduit extending between an inlet aperture and a dispersing aperture; and a hollow fitment having a first portion slidably disposed along said discharge passage and having a second portion that projects into said cap inlet aperture and that is disposed in said cap dispensing conduit to accommodate sliding movement of said cap relative to said fitment, said fitment defining an intermediate passage for communicating between said body discharge passage and said cap dispensing conduit, said fitment being movable along said discharge passage between (1) an elevated dispensing position accommodating fluid flow out of said cap dispensing aperture and (2) a lowered closed position wherein fluid is prevented from flowing out of said cap dispensing aperture;

said closure body top wall defining an anchor hole;

said closure further including a resilient disk member and an outwardly projecting stem; and said stem defining an annular groove whereby said stem is disposed within said anchor hole with a circular edge of said closure body top wall received in said stem annular groove so as to position said resilient disk member over said vent passage.

16. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall and defining a dispensing conduit extending between an inlet aperture and a dispensing aperture; and a hollow fitment having a first portion slidably disposed on said discharge tube and having a second portion that projects into said cap inlet aperture and that is disposed in said cap dispensing conduit to accommodate sliding movement of said cap on said slide surface relative to said fitment, said fitment defining an intermediate passage for communicating between said body discharge tube discharge passage and said cap dispensing conduit, said fitment being movable on said discharge tube between (1) an elevated dispensing position accommodating fluid flow out of said cap dispensing aperture and (2) a lowered closed position wherein fluid is prevented from flowing out of said cap dispensing aperture;

said discharge tube being generally cylindrical and having an annular distal end;

said body having a top wall defining said planar slide surface on which said cap is slidably mounted; and said fitment including (a) a seal surface inside said first portion at one end of said first portion for engaging said annular distal end of said discharge tube to seal closed said discharge passage when said fitment is in said closed position, (b) a pair of spaced-apart, outwardly directed beads around said second portion, and (c) an inwardly directed bead at one end of said first portion at one end of said intermediate passage.

17. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape Upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall and defining a dispensing conduit extending between an inlet aperture and a dispensing aperture; and a hollow fitment having a first portion slidably disposed on said discharge tube and having a second portion that projects into said cap inlet aperture and that is disposed in said cap dispensing conduit to accommodate sliding movement of said cap on said slide surface relative to said fitment, said fitment defining an intermediate passage for communicating between said body discharge tube discharge passage and said cap dispensing conduit said fitment being movable on said discharge tube between (1) an elevated dispensing position accommodating fluid flow out of said cap dispensing aperture and (2) a lowered closed position wherein fluid is prevented from flowing out of said cap dispensing aperture;

said closure further including retainer means for retaining said cap on said top wall to accommodate sliding movement of said cap between (1) an extended, dispensing position in which said cap dispensing aperture projects laterally beyond said closure and (2) a closed position in which said cap dispensing aperture is disposed within the periphery of said body.

18. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall and defining a dispensing conduit extending between an inlet aperture and a dispensing aperture; and a hollow fitment having a first portion slidably disposed on said discharge tube and having a second portion that projects into said cap inlet aperture and that is disposed in said cap dispensing conduit to accommodate sliding movement of said cap on said slide surface relative to said fitment, said fitment defining an intermediate passage for communicating between said body discharge tube discharge passage and said cap dispensing conduit, said fitment being movable on said discharge tube between (1) an elevated dispensing position accommodating fluid flow out of said cap dispensing aperture and (2) a lowered closed position wherein fluid is prevented from flowing out of said cap dispensing aperture;

said closure body including a pair of spaced-apart side walls each defining a guide slot parallel to, and extending along an edge of, said closure body planar slide surface;

each said side wall having a guide surface oriented parallel to said slide surface and defining the top of said guide slot; and said cap having at least one pair of oppositely extending tabs each received in one of said side wall slots, each said tab having a resilient, arcuate configuration with an upper surface engaging the guide surface of the side wall slot in which it is received whereby said side walls and said tabs function as said retainer means.

19. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape Upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall and defining a dispensing conduit extending between an inlet aperture and a dispensing aperture; and a hollow fitment having a first portion slidably disposed on said discharge tube and having a second portion that projects into said cap inlet aperture and that is disposed in said cap disposing conduit to accommodate sliding movement of said cap on said slide surface relative to said fitment said fitment defining an intermediate passage for communicating between said body discharge tube discharge passage and said cap dispensing conduit, said fitment being movable on said discharge tube between (1) an elevated dispensing position accommodating fluid flow out of said cap dispensing aperture and (2) a lowered closed position wherein fluid is prevented from flowing out of said cap dispensing aperture;

said closure body planar slide surface defining front and rear indentations spaced-apart in a linear array; and said cap defining a protuberance shaped to be selectively received in either of said indentations corresponding to said dispensing and closed positions.

20. A dispensing closure for an opening to a squeezable container for holding fluid, said container being of the type having a flexible and resilient wall which can be elastically deformed when subjected to above-ambient external squeezing pressure to temporarily reduce the container volume to force said fluid through said opening and which tends to return to the original undeformed shape upon release of the squeezing pressure, said closure comprising:

a body which can be mounted to said container over said container opening and which has a straight discharge tube defining a discharge passage in communication with said container opening, said body having a planar slide surface oriented at an oblique angle to said tube;

a cap slidable on said top wall and defining a dispensing conduit extending between an inlet aperture and a dispensing aperture; and a hollow fitment having a first portion slidably disposed on said discharge tube and having a second portion that projects into said cap inlet aperture and that is disposed in said cap dispensing conduit to accommodate sliding movement of said cap on said slide surface relative to said fitment, said fitment defining an intermediate passage for communicating between said body discharge tube discharge passage and said cap dispensing conduit, said fitment being movable on said discharge tube between (1) an elevated dispensing position accommodating fluid flow out of said cap dispensing aperture and (2) a lowered closed position wherein fluid is prevented from flowing out of said cap dispensing aperture;

said closure body defining an anchor hole;

said closure further including a resilient disk member and an outwardly projecting stem; and said stem defining an annular groove whereby said stem is disposed within said anchor hole with a circular edge of said closure body top wall received in said stem annular groove so as to position said resilient disk member over said vent passage.

* * * * *